US010874194B2

(12) United States Patent
Fogueteiro

(10) Patent No.: US 10,874,194 B2
(45) Date of Patent: Dec. 29, 2020

(54) ARTICLE FOR COSMETIC COMPRISING A RESERVOIR WITH A COLLAR

(71) Applicant: CHANEL PARFUMS BEAUTE, Neuilly sur Seine (FR)

(72) Inventor: Paulo Fogueteiro, Nogent-sur-Oise (FR)

(73) Assignee: CHANEL PARFUMS BEAUTE, Neuilly sur Seine (FR)

( * ) Notice: Subject to any disclaimer, the term of this patent is extended or adjusted under 35 U.S.C. 154(b) by 0 days.

(21) Appl. No.: 15/516,224

(22) PCT Filed: Oct. 13, 2015

(86) PCT No.: PCT/FR2015/052749

§ 371 (c)(1),
(2) Date: Mar. 31, 2017

(87) PCT Pub. No.: WO2016/062941

PCT Pub. Date: Apr. 28, 2016

(65) Prior Publication Data

US 2017/0295909 A1 Oct. 19, 2017

(30) Foreign Application Priority Data

Oct. 20, 2014 (FR) ..... 14 60091

(51) Int. Cl.
*A46B 17/08* (2006.01)
*A45D 40/26* (2006.01)
*A45D 34/04* (2006.01)

(52) U.S. Cl.
CPC ..... *A45D 40/267* (2013.01); *A45D 34/046* (2013.01); *A45D 40/265* (2013.01)

(58) Field of Classification Search
CPC ..... A45D 40/265; A45D 40/267
USPC ..... 401/121–130; 215/343, 344
See application file for complete search history.

(56) References Cited

U.S. PATENT DOCUMENTS

| | | | | |
|---|---|---|---|---|
| 5,775,827 | A | 7/1998 | Packham et al. | |
| 6,186,689 | B1 | 2/2001 | Sheffler et al. | |
| 6,276,856 | B1 * | 8/2001 | Pieper | A45D 34/046 401/122 |
| 6,581,792 | B1 * | 6/2003 | Limanjaya | B65D 41/3428 215/252 |

(Continued)

FOREIGN PATENT DOCUMENTS

| | | | |
|---|---|---|---|
| CN | 1331432 | C | 8/2007 |
| JP | S60134855 | A | 7/1985 |

(Continued)

OTHER PUBLICATIONS

International Search Report PCT/ISA/210 for International Application No. PCT/FR2015/052749 dated Feb. 8, 2016.

(Continued)

*Primary Examiner* — Jennifer C Chiang
(74) *Attorney, Agent, or Firm* — Harness, Dickey & Pierce, P.L.C.

(57) ABSTRACT

A cosmetic article includes a reservoir of make-up product including a collar having a hole, and a stopper having at least one screw thread and being configured to be screwed onto the reservoir to close the article. The stopper further has at least one scraper that is configured to clean the collar of the reservoir when closing the article.

10 Claims, 5 Drawing Sheets

(56) References Cited

U.S. PATENT DOCUMENTS

| | | | | |
|---|---|---|---|---|
| 7,451,877 | B2 * | 11/2008 | Koga | A45D 33/00 206/581 |
| 7,922,410 | B2 * | 4/2011 | Gueret | A45D 34/045 401/126 |
| 2009/0071498 | A1 | 3/2009 | Tranchant | |

FOREIGN PATENT DOCUMENTS

| | | | |
|---|---|---|---|
| JP | S60134404 | U | 9/1985 |
| JP | H1-82816 | | 6/1989 |
| JP | H3-41608 | | 4/1991 |
| JP | H1023921 | A | 1/1998 |
| RU | 2378966 | C2 | 1/2010 |
| WO | WO-0041588 | A2 | 7/2000 |

OTHER PUBLICATIONS

English Translation of Russian Office Action for corresponding Application No. 2017107865/12 (013761) dated Nov. 28, 2018.
Japanese Notice of Reasons for Rejection for corresponding Application No. 2017-517063, dated Mar. 26, 2019, English translation thereof.
Chinese Reasons for Rejection for corresponding Chinese Application, dated Feb. 18, 2020.
Japanese Reasons for Rejection for corresponding Application No. 2017-517063, dated Feb. 4, 2020, English translation thereof.

* cited by examiner

ARTICLE FOR COSMETIC COMPRISING A RESERVOIR WITH A COLLAR

CROSS-REFERENCE TO RELATED APPLICATIONS

This application is the U.S. National Phase application of PCT Application No. PCT/FR2015/052749 filed on Oct. 13, 2015, which claims priority to French Application No. 1460091 filed on Oct. 20, 2014, the contents of each of which are incorporated herein by reference in their entirety.

FIELD OF THE INVENTION

The invention relates to cosmetic articles.

BACKGROUND OF THE INVENTION

In the field of make-up in particular, numerous articles for applying a product on part of the face are known. These articles generally comprise a product reservoir. The stopper carries a product applicator, which is immersed in the reservoir when the article is closed by screwing the stopper on the reservoir. To apply the product on part of the face, the stopper is unscrewed from the reservoir to release the applicator.

One drawback of these articles is that when opening and closing, residual product is deposited inside and on top of the reservoir collar. These remains dry and are never removed unless cleaned manually by the user. They can mix with the product to be applied, hinder the closing and opening of the article, and give it an unpleasant appearance for the user.

OBJECT AND SUMMARY OF THE INVENTION

An object of the invention is to preserve the cleanliness of the article during its use.

A cosmetic article is therefore provided, which comprises:

a make-up product reservoir comprising a collar having a hole; and a stopper having at least one screw thread able to be screwed onto the reservoir to close it, and further having at least one scraper able to clean the collar of the reservoir when closing the latter.

Thus, the article is self-cleaning. The user has no particular action to carry out compared with her usual use of the product to clean the collar, since cleaning is performed when closing the product as usual.

Advantageously, the or each scraper is also able to clean the collar when opening the reservoir.

Thus, cleaning takes place when both closing and opening the article.

Preferably the or each scraper is able to clean a top of the collar.

Thus, it is the upper part of the collar, i.e. the part seen by the user, which is cleaned.

Advantageously, the or each scraper comprises two parts, one part having a free end edge of the scraper and being made of a more flexible material than the other part.

Thus, the or each scraper deforms if it touches the reservoir and there is good contact between the scraper and the reservoir for better cleaning.

Preferably, the stopper further comprises at least one housing able to collect the product removed from the collar by the scraper(s).

Thus, the product is sent into the stopper where it is out of the way and is not visible to the user.

Advantageously, the or each housing is adjacent to the scraper(s).

Thus, the product is easily sent into the housing(s) by the scraper(s).

Preferably, there are at least two scrapers.

Advantageously, the stopper comprises an even number of screw threads and an odd number of scrapers, preferably three or even five.

Thus, depending on the position in which the user starts to close the stopper on the reservoir, the thread entry taken by the stopper changes, and the position of the scrapers changes. The scraping quality is therefore improved since the scrapers are positioned at different places over time to start cleaning.

Preferably, the article further comprises a wiper arranged inside the reservoir and whose end closest to the hole is set back from the latter.

Thus, the wiper does not interfere with the cleaning action of the scrapers. Furthermore, when the residual product is pulled up by the applicator when opening the article, it first collects above the wiper while remaining in the collar. It is then hidden from view. The next time the reservoir is opened, when the applicator is taken out it picks up this product and deposits it on the top of the collar. Finally, the next time the reservoir is closed, the scrapers take the product with them.

Advantageously, the stopper carries a make-up product applicator rod, the rod having at least one groove not perpendicular to a longitudinal direction of the rod.

The product is therefore easier to remove since it can flow through the grooves towards the inside of the reservoir or towards the top of the collar.

The invention also provides for a method for cleaning a reservoir of a cosmetic article, comprising a step wherein the article is closed by screwing a stopper on the reservoir, so that at least one scraper of the stopper cleans a collar of the reservoir.

BRIEF DESCRIPTION OF THE DRAWINGS

We will now describe one embodiment of the invention as a non-limiting example referring to the attached drawings, in which.

MORE DETAILED DESCRIPTION

Figure 1:
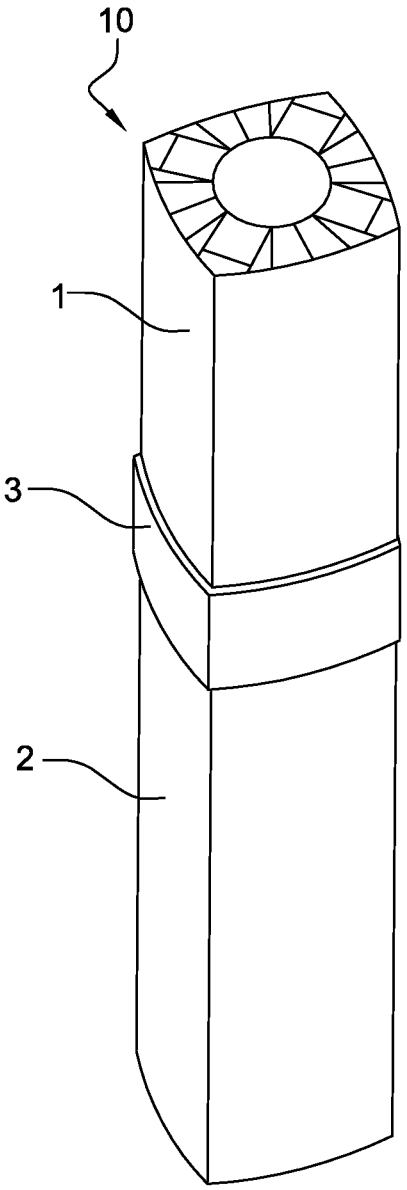
FIGS. 1 to 3 illustrate a make-up product in perspective according to one embodiment of the invention, the article being respectively closed, open, and in exploded view.
Figure 10:
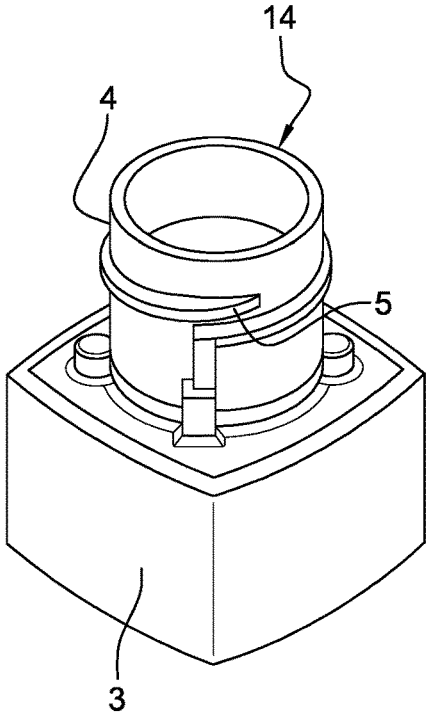
FIG. 10 illustrates a perspective view of a hoop of the article showing the reservoir collar.

The make-up article 10 illustrated on FIG. 1 comprises a reservoir 2 of product 30 and a stopper 1. The article has a general axis 31, referenced on FIG. 4, corresponding to its longitudinal direction. Once closed, article 10 has a generally cylindrical shape of square cross-section, the square having its four corners slightly rounded. In the middle of its length, the reservoir has a hoop base 3 whose exterior is visible. It corresponds to the top of the reservoir for which it forms a collar 4 shown on FIGS. 2 and 3. It is shown in more detail on FIG. 10. The collar has a generally annular shape with a circular top 14. The reservoir could have any other cross-section, including circular, or any other shape, geometrical or not.

Figure 2:
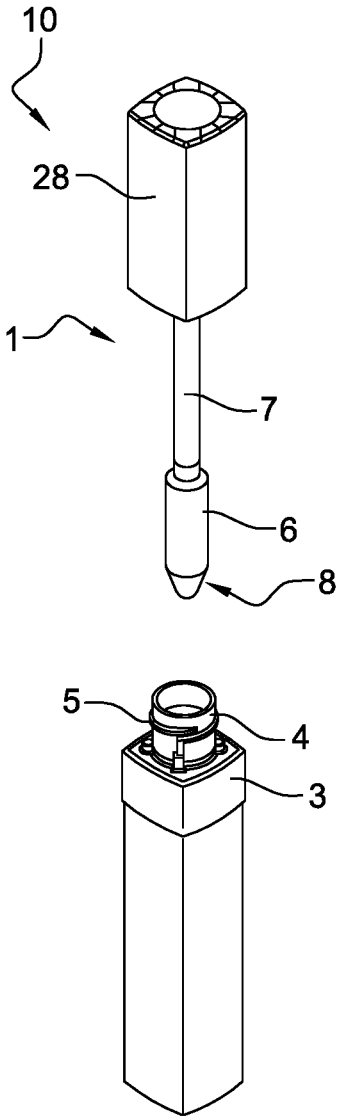

FIG. 2 illustrates the article in the open position. Thus, the stopper is unscrewed from the reservoir, which in this case has two threads 5 on the collar 4. The stopper carries a product applicator 6 via a cylindrical rod 7. In this case the applicator 6 is a brush which is attached to the rod 7 by pressing and clamping.

The brush 6 has a mainly cylindrical shape, its radius being greater than that of the rod 7, and its free end 8 being tapered.

The brush can be of any type. In this case, it is a brush of the bottle-brush type, with bristles trapped between two twisted metal wires. However, it could also be an injected brush made of one or more synthetic materials and having bristle and/or teeth integral with the rod. The applicator could also form a comb rather than a brush. Such brushes are particularly suitable when the article comprises mascara and is used for making up the eyelashes or eyebrows, as is the case here.

However, the invention is also applicable to other make-up articles such as nail polish or lip gloss. The applicator could then consist of a brush used for nail polish or of a tip either bare or with bristles deposited by flocking.

Figure 3:
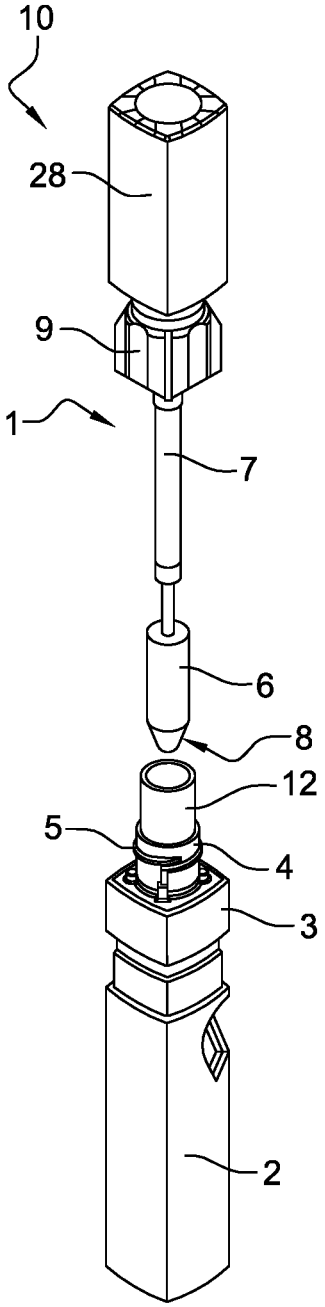
Figure 7:
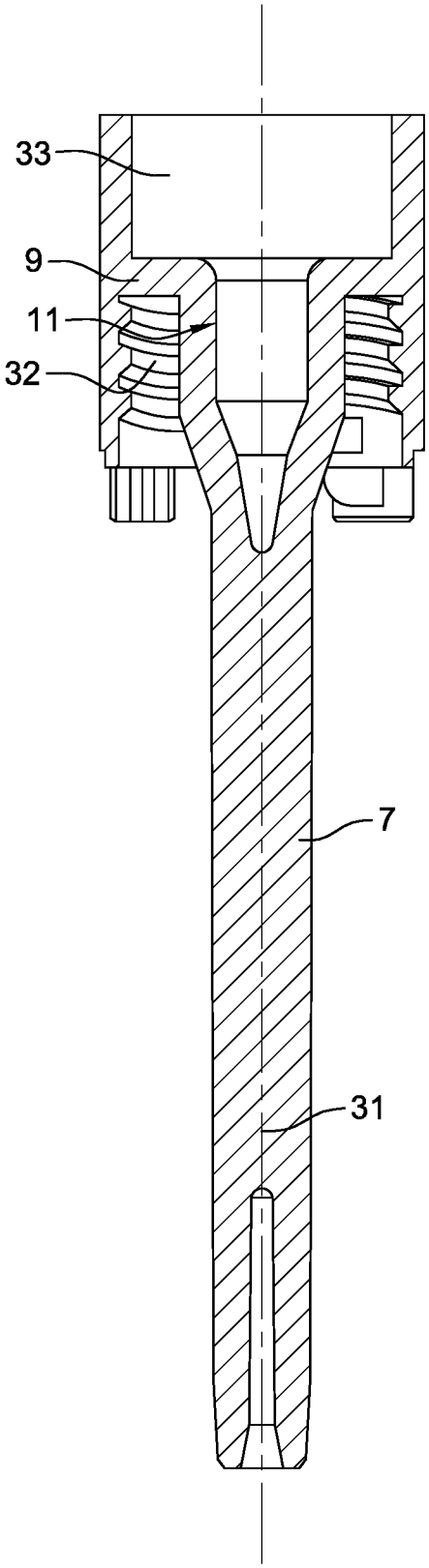

FIG. 3 is an exploded view of the article. It shows a cap 28 forming the outer part of the stopper 1 when the article is closed and a body 9 in one piece, rigidly attached to the cap 28 and whose lower part forms the rod 7. This body 9 has in its upper part an annular cavity 11 shown on FIG. 7, open at the bottom and having on its outer face an inner thread 32 also provided with two threads and allowing the stopper to be screwed onto the thread 5 of the collar 4. Thus, the body 9 also positions and holds one end of the rod 7 in the cap 28.

Figure 4:
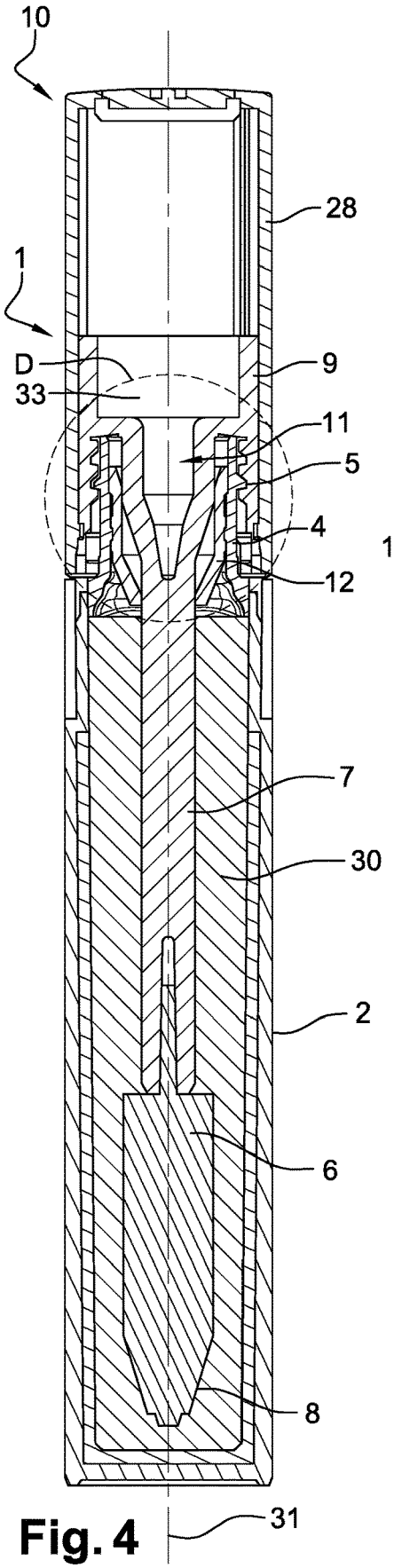
FIG. 4 illustrates an axial cross-sectional view of the closed article.
Figure 5:
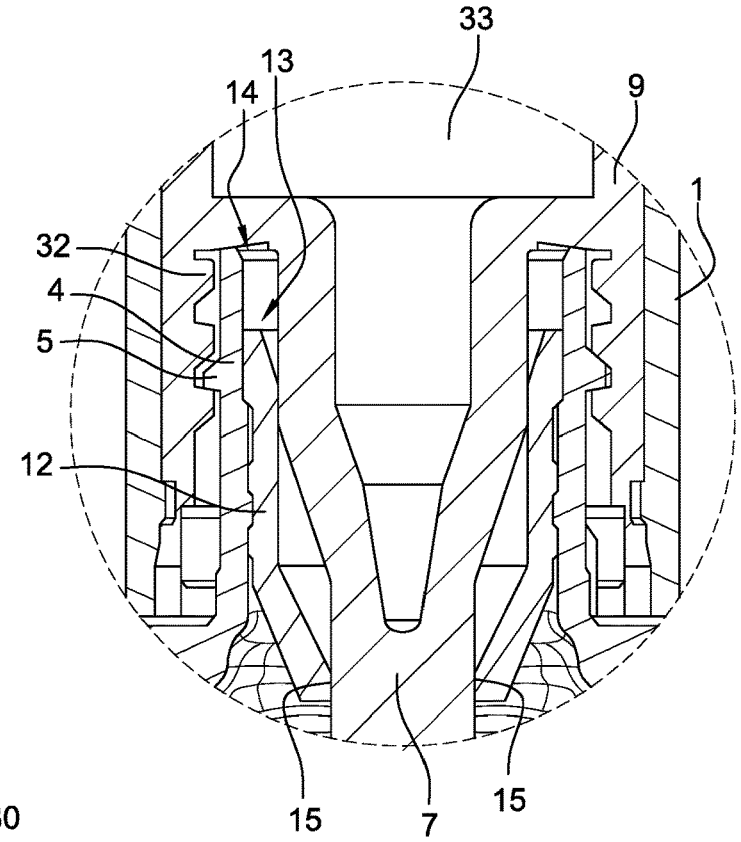
FIG. 5 illustrates a larger-scale view of a detail D of FIG. 4.
Figure 6:
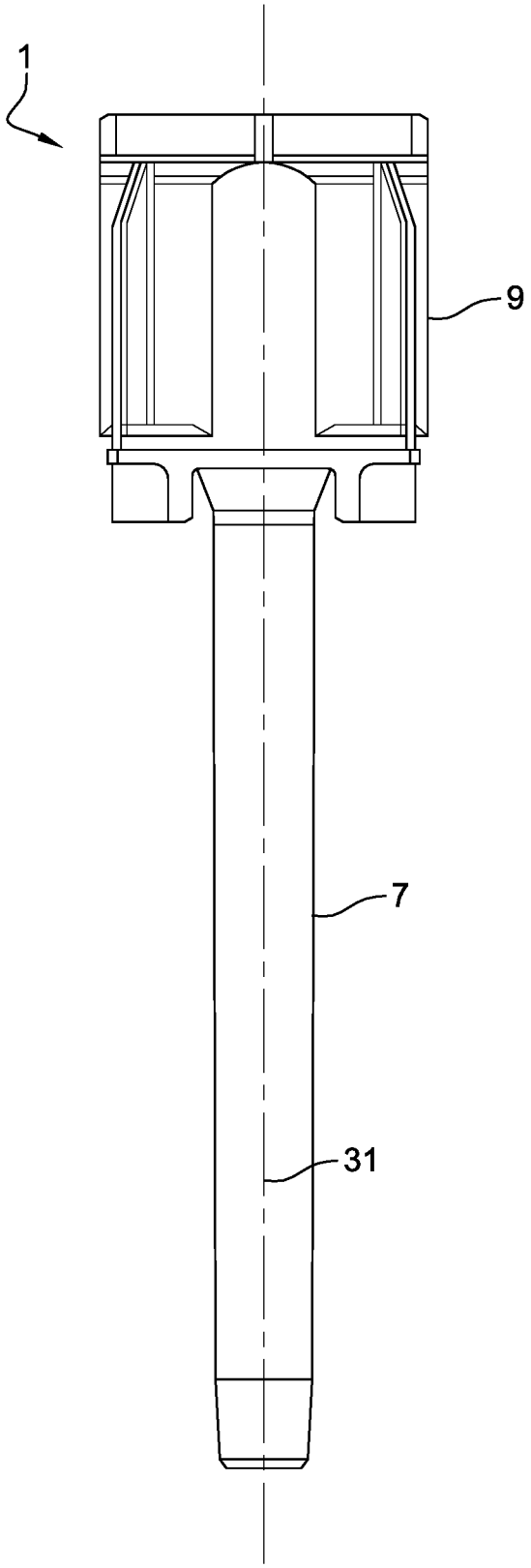
FIGS. 6, 7, 8 and 9 illustrate a body of the article stopper, respectively from the front, in axial cross-section, in perspective centered on the upper part, and from above.

FIG. 3 also shows a wiper 12 which is placed in the reservoir as described below. FIGS. 4 and 5 show the wiper 12, located in the collar 4, between the latter and the rod 7. A free upper end 13 of the wiper 12 is set back from the free upper end 14 of the collar 4 along the axial direction, as shown on FIG. 5.

The wiper wipes the applicator as it comes out of the reservoir, before it reaches the collar, with a frustoconical lower section of the wiper. A lower edge of this section provides an annular sealing function on the rod 7 in its upper part 15 when the article is closed.

In addition, when opening, the rod or the applicator deposits product 30, referenced on FIG. 4, between the end 13 of the wiper 14 and the top 14 of the collar 4. During a subsequent opening, this residual product is again picked up by the rod or the applicator and deposited this time on the top 14 of the collar. Thus, in two opening actions, product is brought from the reservoir up to the top of the collar. This construction method gives good results, however the invention also relates to a wiper of conventional type, which is mounted in the collar, and which provides a seal by a frustoconical portion which receives a frustoconical portion of the rod. It may also rest against the top of the collar. The reservoir collar could also have no wiper.

Figure 8:
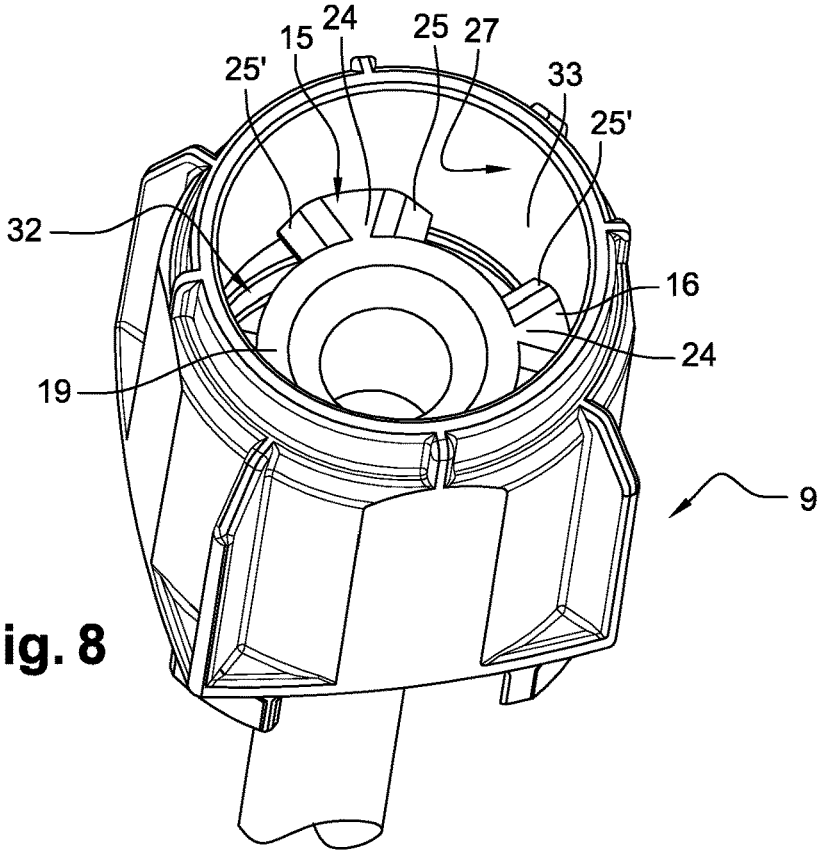
Figure 9:
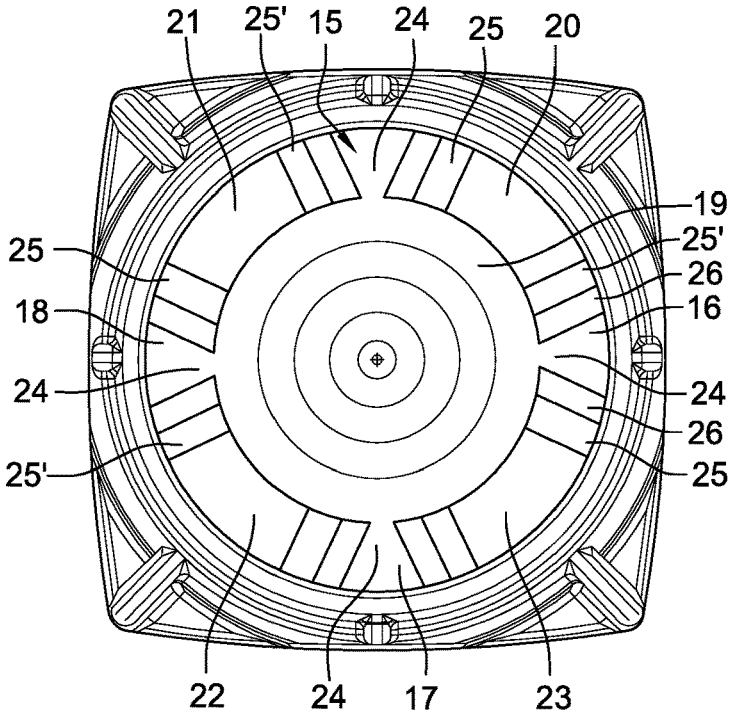

FIGS. 8 and 9 illustrate the upper part of the body 9, housed in the cap 28. Above the cavity 11, we see four scraping elements 15, 16, 17 and 18 located between a central frustoconical section 19 and the outer wall 27 of the body 9. These scraping elements each have a central part 24 whose width increases between the central section 19 and the wall 27. On each side of this central part, the element comprises two scrapers 25 and 25' inclined towards the cavity 11. There is a chamfer 26 between the central part 24 and the scrapers 25 and 25'. The chamfer is however optional. In this case therefore, there are eight scrapers. Four scrapers 25 are directed clockwise, the other four referenced 25' are directed anticlockwise. Each scraper has a lip forming its free end and directed towards the cavity 11.

Between the scrapers and the end wall of the cap, the stopper comprises a housing 33, referenced on FIGS. 4, 5, 7 and 8, bounded by these elements and communicating with the cavity 11 through openings 20, 21, 22, and 23 located between the scrapers in the circumferential direction.

When closing the article, the thread 32 of the stopper cooperates with that of the collar 4 to give the body 9 a helical movement along the axis 31 of the article. Thus, the scrapers 25 and 25' move towards the top 14 of the collar 4 until they reach it. When there is some product on the top 14 of the collar 4, the scrapers 25 or 25' pick up the product which is taken towards the openings 20, 21, 22, and 23 due to the inclination of the scrapers and deposited in the housing 33. Thus, by screwing in the clockwise direction, the four scrapers 25 pick up the product and take it into the housing 33. When the article is in the closed position, the scrapers remain in contact with the collar 4.

Therefore, when opening the article, by unscrewing the cap in the anticlockwise direction, it is this time the four scrapers 25' which pick up any product likely to be still on the collar and take it into the housing 33 in the same way. Operation in the opposite direction could of course be considered.

Figure 11:
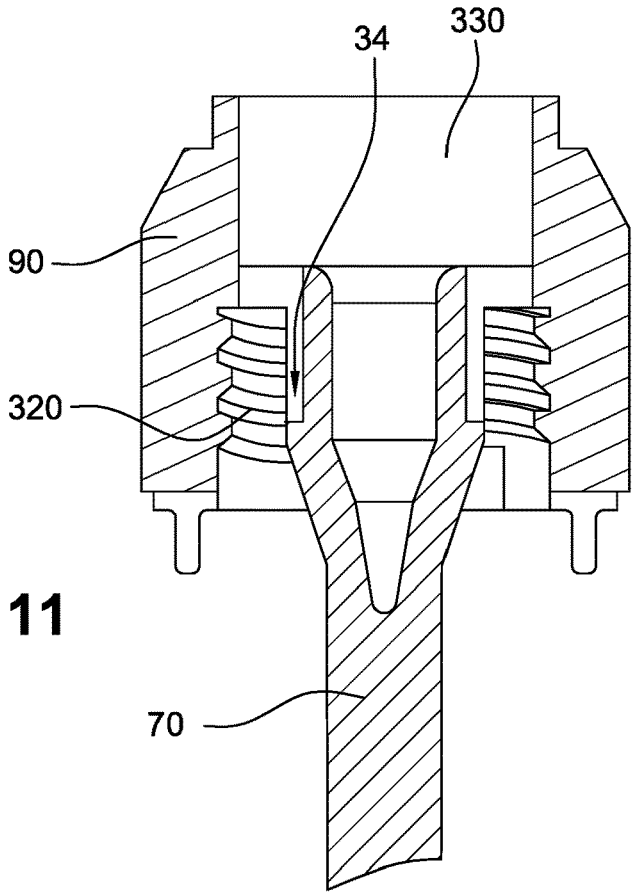
FIGS. 11 and 12 illustrate views of the stopper body according to a variant, respectively in axial cross-section and from above.
Figure 12:
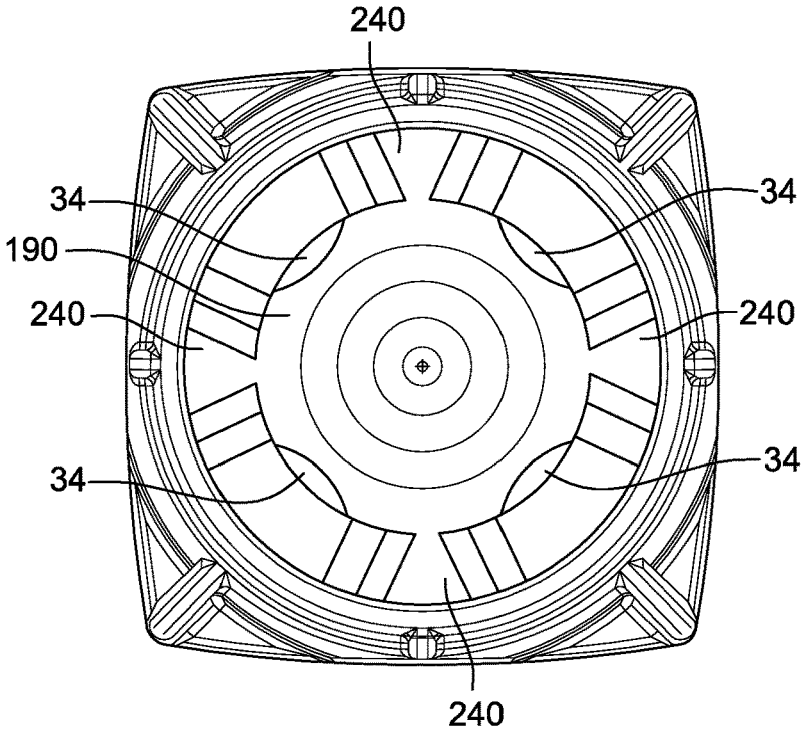

In a variant illustrated on FIGS. 11 and 12, the central section 190 has longitudinal channels 34 in its upper part. They guide the product either towards the collar or towards the reservoir by creep or flow depending on the viscosity of the make-up product. They therefore communicate with the housing 330 to collect the product.

In a variant not shown, the scrapers may include a base and a free end part made of a material more flexible than that of the base, using for example a bi-injection method. Thus, the scrapers deform substantially when they press against the top 14 of the collar 4. The contact between the scraper and this part of the reservoir is therefore greater and scraping is improved.

Lastly, in another variant, the stopper comprises an even number of screw threads, for example two, and an odd number of scrapers, for example three. This results in different cleaning depending on the position of the stopper on the reservoir when closing starts. Thus, depending on the angular position of the stopper relative to the reservoir when the user starts to screw, one of the threads is selected instead of the other, and the position of the scrapers when they come into contact with the product depends on this thread. If at another time, the user starts to screw in another angular position, another thread is selected and the position of the scrapers is also different when starting the cleaning. Thus, cleaning is optimized since all the scrapers clean over time different positions on the reservoir collar.

The body 9 will preferably be made of one or more synthetic materials.

Obviously, numerous modifications can be made without leaving the scope of the invention.

The product corresponds to any type of make-up product. It can be a gloss or a nail polish.

The invention is also applicable to a care product, and generally to any cosmetic product.

What is claimed is:

1. A cosmetic article comprising:

a reservoir configured to contain make-up product, the reservoir including a collar having a hole; and a stopper having at least one screw thread and configured to be screwed onto the reservoir to close the reservoir, and further having at least one scraper configured to clean a top of the collar of the reservoir when closing the reservoir, wherein the at least one scraper lies on the top of the collar when the cosmetic article is closed, and wherein the at least one scraper includes at least two inclined scrapers, one of the at least two inclined scrapers oriented clockwise, and another of the at least two included scrapers oriented counter-clockwise.

2. The cosmetic article according to claim 1, wherein the at least one scraper is further configured to clean the collar when opening the reservoir.

3. The cosmetic article according to claim 1, wherein the at least one scraper comprises two parts, one part having a free end edge of the scraper and being made of a more flexible material than another part.

4. The cosmetic article according to claim 1, wherein the stopper further comprises at least one housing configured to collect the make-up product removed from the collar by the at least one scraper.

5. The cosmetic article according to claim 4, wherein the at least one housing is adjacent to the at least one scraper.

6. The cosmetic article according to claim 1, wherein the stopper comprises an even number of screw threads and an odd number of scrapers.

7. The cosmetic article according to claim 6, wherein the stopper comprises one of three scrapers and five scrapers.

8. The cosmetic article according to claim 1, further comprising a wiper inside the reservoir, an end of the wiper that is closest to the hole being set back from the hole.

9. The cosmetic article according to claim 1, wherein the stopper includes a make-up product applicator rod, the make-up product applicator rod having at least one groove that is not perpendicular to a longitudinal direction of the make-up product applicator rod.

10. A method for cleaning a reservoir configured to contain make-up product of a cosmetic article, the reservoir including a collar having a hole, the method comprising:

closing the cosmetic article by screwing a stopper on the reservoir, said stopper having at least one screw thread, wherein a top of the collar of the reservoir is cleaned by at least one scraper of the stopper during the closing of the cosmetic article, wherein the at least one scraper lies on the top of the collar when the cosmetic article is closed, and wherein the at least one scraper includes at least two scrapers.

* * * * *